US012140400B2

(12) United States Patent
Newsom et al.

(10) Patent No.: US 12,140,400 B2
(45) Date of Patent: Nov. 12, 2024

(54) REVOLVER

(71) Applicant: NRArms, Jenkins, KY (US)

(72) Inventors: Daryl G. Newsom, Jenkins, KY (US); Levi Newsom, Jenkins, KY (US)

(73) Assignee: NRARMS, Jenkins, KY (US)

( * ) Notice: Subject to any disclaimer, the term of this patent is extended or adjusted under 35 U.S.C. 154(b) by 198 days.

(21) Appl. No.: 17/532,007

(22) Filed: Nov. 22, 2021

(65) Prior Publication Data

US 2022/0090877 A1 Mar. 24, 2022

Related U.S. Application Data

(63) Continuation-in-part of application No. 17/478,990, filed on Sep. 20, 2021, now abandoned.

(60) Provisional application No. 63/081,956, filed on Sep. 23, 2020.

(51) Int. Cl.
*F41C 3/14* (2006.01)
*F41C 9/02* (2006.01)

(52) U.S. Cl.
CPC . *F41C 3/14* (2013.01); *F41C 9/02* (2013.01)

(58) Field of Classification Search
CPC ..... F41C 3/14; F41C 9/00; F41C 9/02; F41A 9/00; F41A 9/02
See application file for complete search history.

(56) References Cited

U.S. PATENT DOCUMENTS 6,925 A * 12/1849 Pecare ..... F41A 19/10 42/69.01
28,461 A * 5/1860 Elliot ..... F41C 3/14 42/59
51,752 A * 12/1865 Reid ..... F41A 9/28 42/59
752,893 A * 2/1904 Evensen ..... F41C 3/14 42/1.16

(Continued)

FOREIGN PATENT DOCUMENTS

GB 190902462 A * 7/1909
GB 2278909 A * 12/1994 ..... F41A 19/07
WO WO-9838468 A1 * 9/1998 ..... F41A 19/18

OTHER PUBLICATIONS

Home Made Gun Plan for 22 Caliber Revolver. "HMGP". Mar. 16, 2018. (Year: 2018).*

*Primary Examiner* — Gabriel J. Klein
(74) *Attorney, Agent, or Firm* — Bennet K. Langlotz; Langlotz Patent & Trademark Works, LLC

(57) ABSTRACT

Revolvers have a frame, a cylinder rotatably mounted to the frame and defining a plurality of passages, each passage having a chamber configured to receive a cartridge, each passage defining a bore forward of the chamber and configured to closely receive a bullet and retain propellant pressure to expel the bullet, and each bore having a forward aperture. A firing facility may be connected to the frame rearward of the cylinder and registered with a selected one of the passages, the revolver being free of elements forward of the selected one of the passages. The frame may include a ring defining an aperture configured to receive a first finger. The ring may be free of a trigger. A finger rest may be outside of the ring and configured to engage a second finger. The finger rest may be an elongated arcuate extension having a free end away from the frame.

17 Claims, 6 Drawing Sheets

(56) References Cited

U.S. PATENT DOCUMENTS

| | | | | | |
|---|---|---|---|---|---|
| 759,415 | A * | 5/1904 | Bourne | F41C 23/10 | 42/71.02 |
| 1,461,600 | A * | 7/1923 | Cottrell | F41G 1/35 | 42/146 |
| 1,537,369 | A * | 5/1925 | Nicholson | F41C 3/14 | 42/59 |
| 1,618,976 | A * | 3/1927 | Hofmann | F41C 3/14 | 42/1.11 |
| 2,036,925 | A * | 4/1936 | Curtis | F41C 23/10 | 42/71.02 |
| 2,082,288 | A * | 6/1937 | Hillyard | F41C 3/14 | 42/59 |
| 3,122,060 | A * | 2/1964 | Reed | F41A 9/27 | 42/59 |
| 3,296,729 | A * | 1/1967 | Stevens, Jr. | F41C 23/10 | 42/59 |
| 4,122,621 | A * | 10/1978 | Barr | F41A 9/73 | 42/1.14 |
| 4,126,953 | A * | 11/1978 | Casull | F41C 3/14 | 42/59 |
| 5,815,972 | A * | 10/1998 | Anderson | F41G 1/54 | 42/114 |
| 2006/0005443 | A1 * | 1/2006 | Camp | F41C 9/02 | 42/1.08 |

* cited by examiner

REVOLVER

CROSS-REFERENCE TO RELATED APPLICATION

This application is a Continuation-in-Part of U.S. patent application Ser. No. 17/478,990 filed on Sep. 20, 2021, entitled "RING FIREARM ASSEMBLY," which claims the benefit of U.S. Provisional Patent Application No. 63/081,956 filed on Sep. 23, 2020, entitled "RING FIREARM ASSEMBLY," which are hereby incorporated by reference in their entirety for all that is taught and disclosed therein.

FIELD OF THE INVENTION

The present invention relates to firearms, and more particularly to a revolver that enables concealed carry of the revolver in a user's hand.

BACKGROUND AND SUMMARY OF THE INVENTION

Concealed carry is the practice of carrying a firearm, usually a handgun, in public in a concealed manner. Typical concealed carry locations include pants and coat pockets, purses, and bags. Challenges posed by size, weight, and concealability make many firearms unsuitable for concealed carry. Difficulties with concealing a small gun often dictate what a user can wear if the user is carrying. Concealed carry of a handgun in a user's clothing can also impede the user's movements.

Therefore, a need exists for a new and improved revolver that enables concealed carry of the revolver in a user's hand. In this regard, the various embodiments of the present invention substantially fulfill at least some of these needs. In this respect, the revolver according to the present invention substantially departs from the conventional concepts and designs of the prior art, and in doing so provides an apparatus primarily developed for the purpose of enabling the concealed carry of the revolver in a user's hand.

The present invention provides an improved revolver, and overcomes the above-mentioned disadvantages and drawbacks of the prior art. As such, the general purpose of the present invention, which will be described subsequently in greater detail, is to provide an improved revolver that has all the advantages of the prior art mentioned above.

To attain this, the preferred embodiment of the present invention essentially comprises a frame, a cylinder rotatably mounted to the frame and defining a plurality of passages, each passage having a chamber configured to receive a cartridge, each passage defining a bore forward of the chamber and configured to closely receive a bullet and retain propellant pressure to expel the bullet, and each bore having a forward aperture. A firing facility may be connected to the frame rearward of the cylinder and registered with a selected one of the passages, the revolver being free of elements forward of the selected one of the passages. The frame may include a ring defining an aperture configured to receive a first finger. The ring may be free of a trigger. A finger rest may be outside of the ring and configured to engage a second finger. The finger rest may be an elongated arcuate extension having a free end away from the frame. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
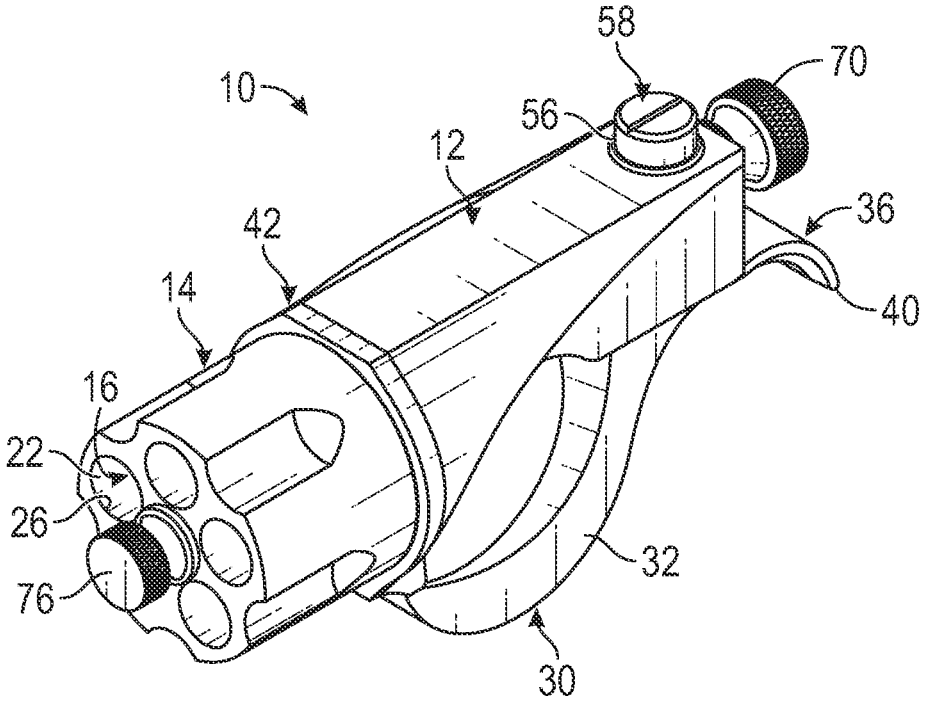
FIG. 1 is a top isometric view of the current embodiment of a revolver constructed in accordance with the principles of the present invention.
Figure 2:
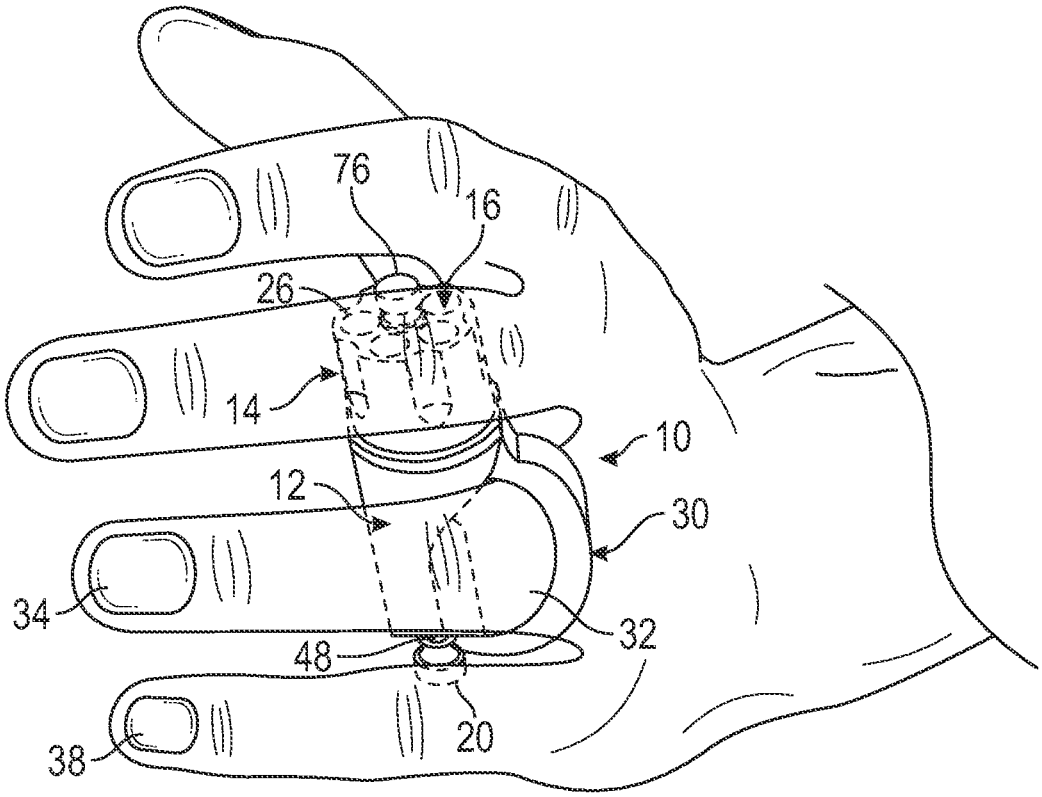
FIG. 2 is a bottom isometric view of the revolver of FIG. 1 in use being worn on a user's finger with the firing pin in the uncocked condition.
Figure 3:
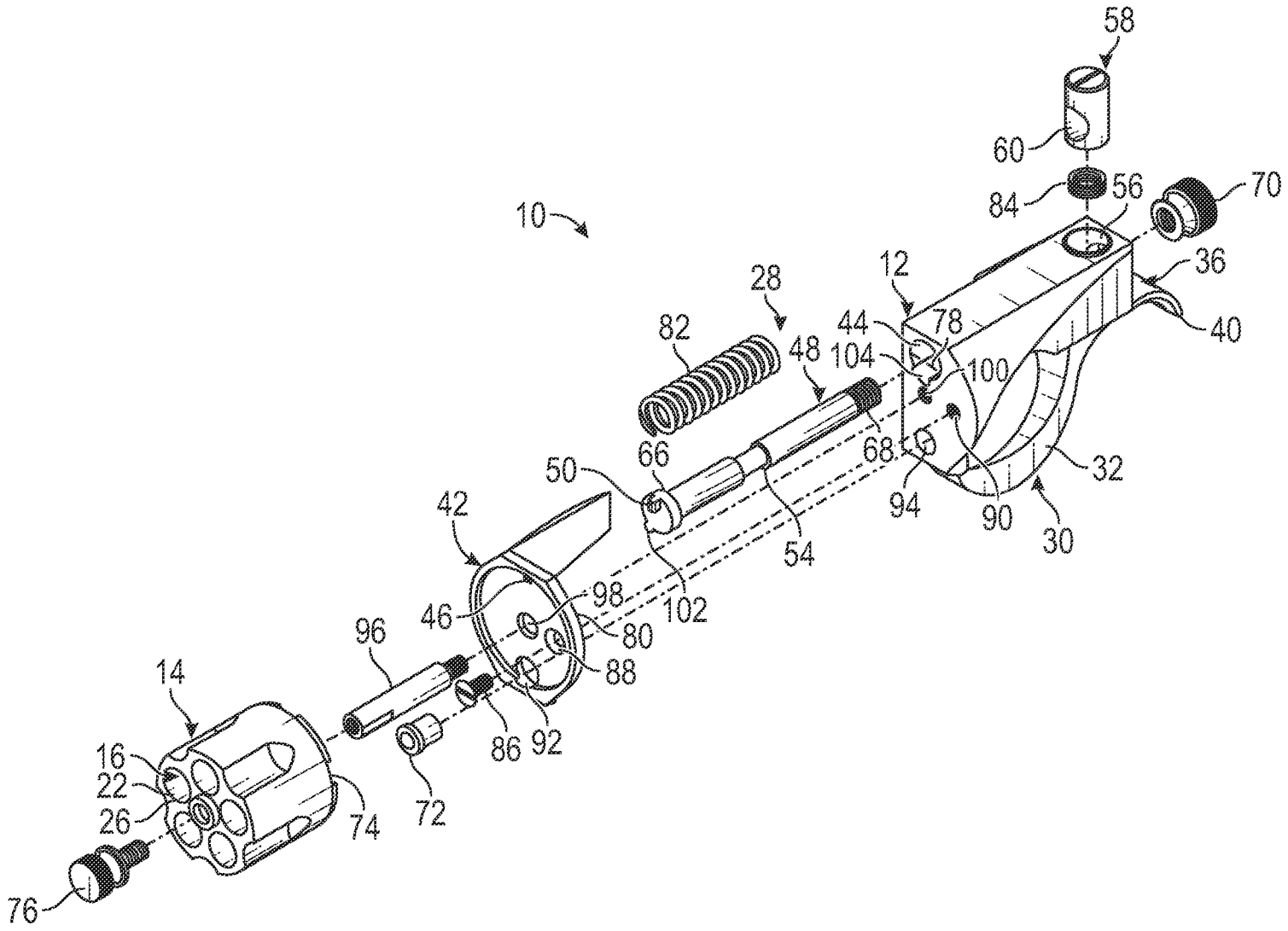
FIG. 3 is an exploded view of the revolver of FIG. 1.
Figure 4:
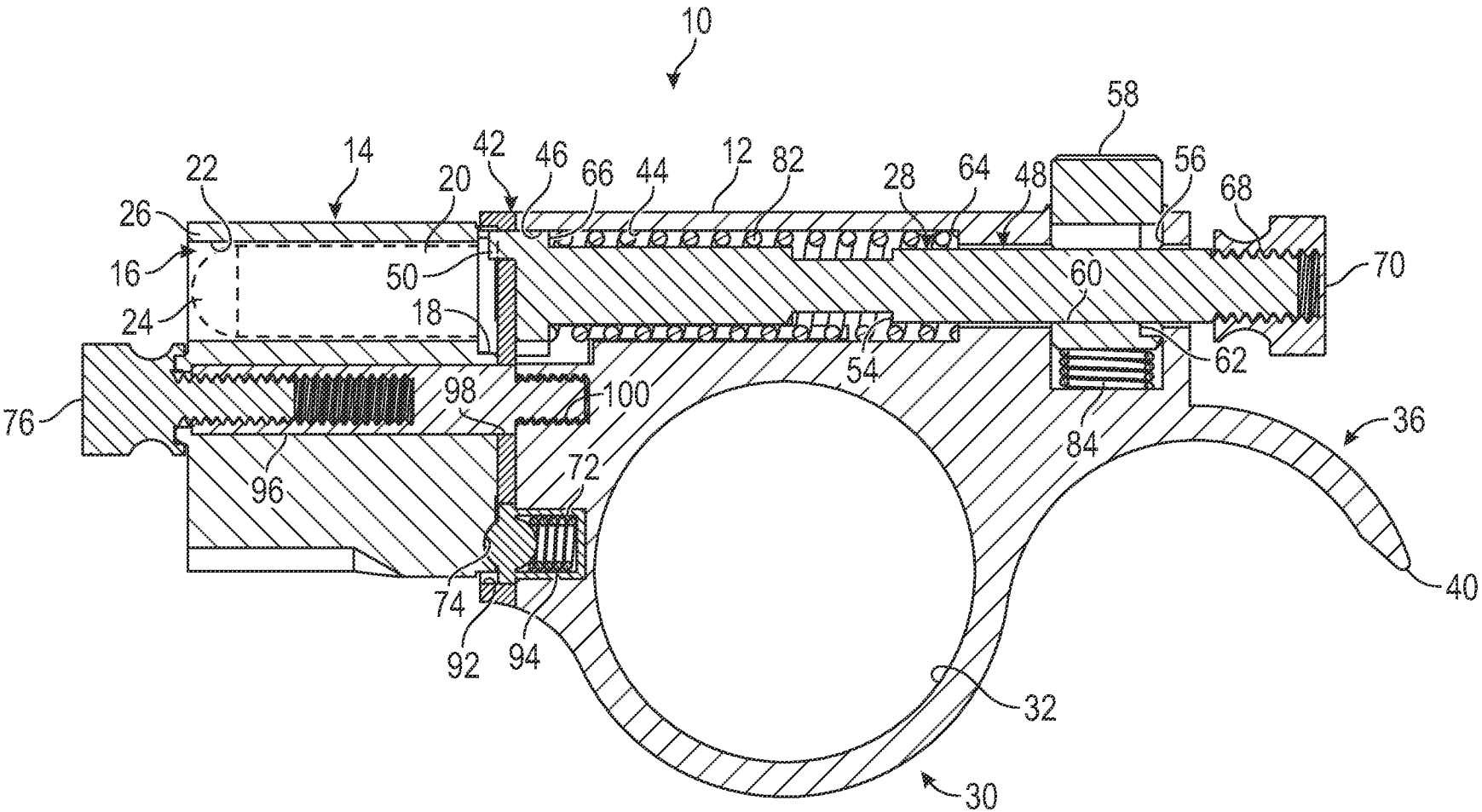
FIG. 4 is a side sectional view of the revolver of FIG. 1 with the firing pin in the uncocked condition.
Figure 5:
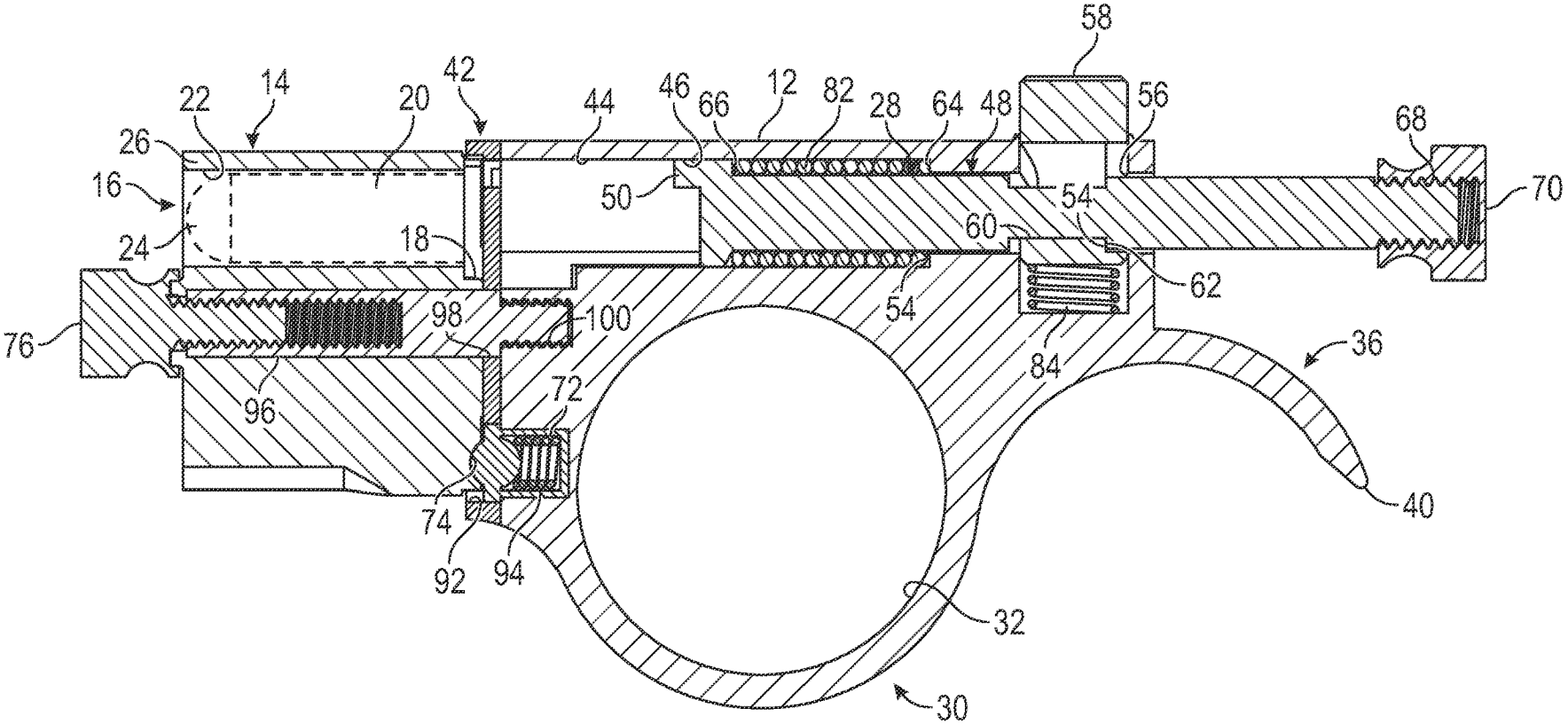
FIG. 5 is a side sectional view of the revolver of FIG. 1 with the firing pin in the cocked condition.

An embodiment of the revolver of the present invention is shown and generally designated by the reference numeral 10.

FIGS. 1-5 illustrate the improved revolver 10 of the present invention. More particularly, the revolver has a frame 12 with a cylinder 14 rotatably mounted to the frame and defining a plurality of passages 16. Each passage has a chamber 18 configured to receive a cartridge 20. In the current embodiment, the cartridge is a rimfire cartridge. Each passage defines a bore 22 forward of the chamber and configured to closely receive a bullet 24 and retain propellant pressure to expel the bullet. Each bore has a forward aperture 26.

A firing facility 28 is connected to the frame 12 rearward of the cylinder 14 and is registered with a selected one of the passages 16. The revolver 10 is free of elements forward of the selected one of the passages. The frame includes a ring 30 defining an aperture 32 configured to receive a first finger 34. The ring is free of a trigger and includes a finger rest 36 outside of the ring and configured to engage a second finger 38. In the current embodiment, the finger rest is an elongated arcuate extension having a free end 40 away from the frame.

A frame plate 42 is located between the cylinder 14 and the frame 12. The frame defines a firing pin bore 44 having a width 78. The frame plate defines a firing pin aperture 46 having a width less than the firing pin bore width in the current embodiment. A firing pin 48 is received in the firing pin bore and has an offset firing pin protrusion 50 configured to pass through the firing pin aperture to discharge an aligned rim of a rimfire cartridge 20. The firing pin is configured to reciprocate between a rear cocked position shown in FIG. 5 and a forward discharge/rest position shown in FIG. 4 and is spring biased in a forward direction by a firing pin spring 82. The firing pin has a forward-facing shoulder 54.

The frame 12 defines a trigger passage 56 transverse to the firing pin bore 44. A trigger element 58 defines an aperture 60 receiving the firing pin 48. The trigger element is spring biased in an upward direction by a trigger spring 84. The trigger element includes a sear surface 62 operably engaging the forward-facing shoulder 54 of the firing pin and configured to releasably engage the firing pin. The trigger element reciprocates with respect to the frame. The firing pin bore has a forward-facing stop surface 64, and the firing pin has an engagement surface 66 configured to compress the firing pin spring 82 between the engagement surface and the forward-facing stop surface and to limit rearward excursion of the firing pin. Thus, the firing pin is removable from the frame only in a forward direction. The frame plate 42 is forward of the firing pin and is configured to prevent removal of the firing pin from the frame except upon removal of the frame plate from the frame. The frame plate is secured to the frame by a screw 86 received in a bore 88 defined by the frame plate and threadedly received in a bore 90 defined by the frame. The firing pin has a threaded rear end 68 including a cocking handle 70 configured to withdraw the firing pin in a rearward direction to cock the revolver 10.

A spring detent element 72 is on the frame 12 facing the cylinder 14. The spring detent element is received by a bore 92 in the frame plate 42 and an aperture 94 in the frame. The cylinder defines a plurality of detent pockets 74, each associated with a passage 16. A cylinder thumb screw 76 rotatably secures the cylinder to a stand-off 96. The stand-off is secured to the frame by being received by a bore 98 defined by the frame plate and being threadedly received by an aperture 100 defined by the frame. The cocking handle 70 is attached to the rear of the firing pin 48 and protrudes from the rear of the frame.

Figure 6:
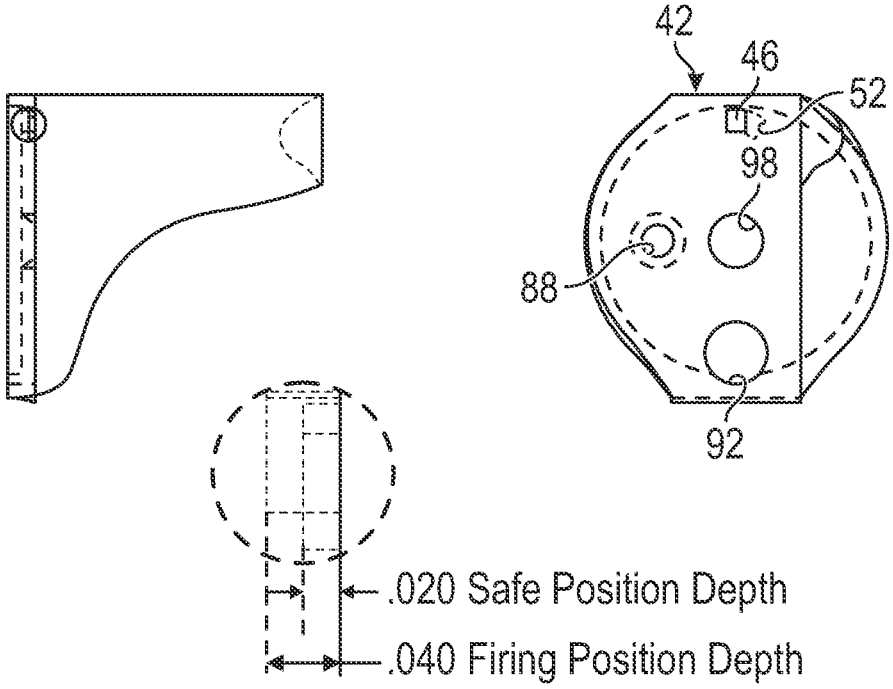
FIG. 6 is a rear view of the frame plate of FIG. 1.
Figure 7:
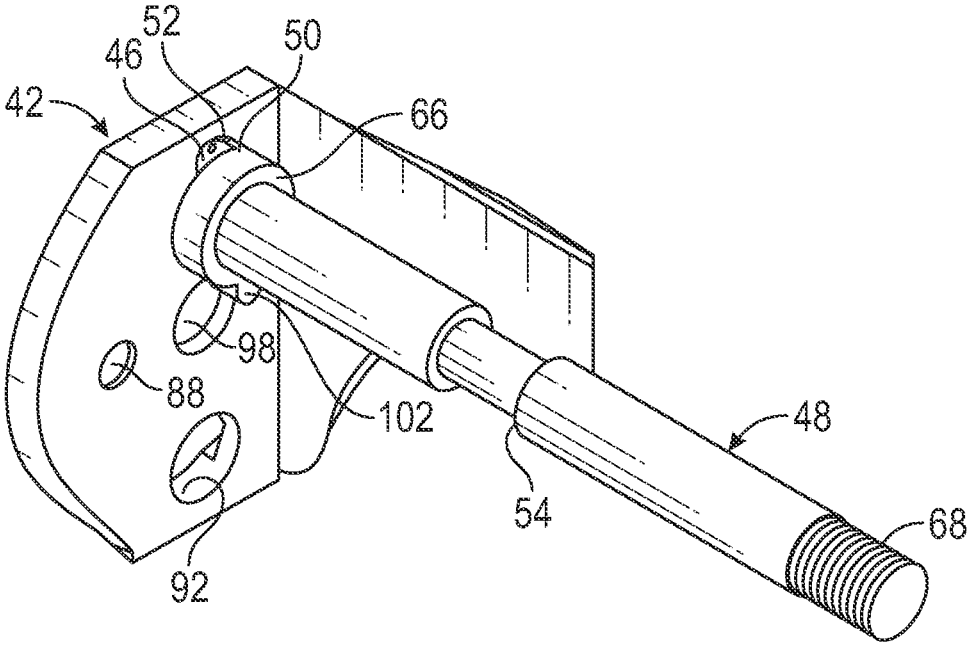
FIG. 7 is a top isometric view of the frame plate and firing pin of FIG. 1 with the firing pin in the safe position.

FIGS. 6 and 7 illustrate the improved frame plate 42 of the present invention. More particularly, to prevent accidental discharge, the revolver 10 includes a safety position for the firing pin 48. The frame plate has a rear surface 80 facing the frame 12. The rear surface defines a firing pin safety pocket 52 away from the firing pin aperture 46 and is configured to receive the firing pin protrusion 50. In the current embodiment, the firing pin safety pocket is 0.020 inch deep, and the firing pin aperture is 0.040 inch deep, which enables the firing pin aperture to penetrate entirely through the frame plate while the firing pin safety pocket does not. To render the revolver safe, the user rotates the firing pin clockwise using the cocking handle 70 until the user feels the firing pin drop into the firing pin safety pocket, which is as far as the firing pin can rotate clockwise. To exit the safe condition, the user rotates the firing pin counterclockwise using the cocking handle as far as possible, which aligns the firing pin protrusion with the firing pin aperture and makes the firing pin ready to cock. The firing pin's range of rotation is limited to 30° in the current embodiment by a protrusion 102 on the firing pin that is received by a notch 104 defined by the frame and in communication with the firing pin bore 44 in the current embodiment.

In the current embodiment, the revolver 10 is a small .22-short caliber five shot handgun. The frame of the revolver can be produced from any suitable metal, including mild steel, stainless steel, aluminum, or bronze. The frame is 1.35" tall and 2.25" long. The cylinder, which is attached to the front of the frame, is made from a higher-grade steel than the frame to be able to withstand pressures resulting from the discharge of a cartridge and is 0.780" in diameter and 0.7" in length. It should be appreciated that the revolver does not include a conventional barrel to minimize the revolver's length, and the forward aperture of the bore portion of each chamber serves as a muzzle. The revolver can be manufactured with different ring sizes and styles to fit men and women, as well as in different colors. A version with a three-round cylinder could be manufactured to enable concealability by women and men with small hands that cannot accommodate the five-round cylinder version.

The revolver is loaded by unscrewing the cylinder thumb screw and pulling the cylinder off the frame, loading each passage with a .22 short rifle rimfire cartridge, and reattaching the cylinder to the frame using the cylinder thumb screw. For concealed carry, the user places the revolver on the desired finger with the ring facing up to look like a wedding band or conventional ring while the user palms the rest of the revolver for concealment. The revolver can be worn on the ring finger or middle finger of either of the user's hands.

If the revolver is needed for self-defense, the user rotates the ring 180° around the finger to place the remainder of the revolver into a ready to fire position. While holding the revolver in the ready to fire position with one hand, the user uses their other hand to pull the firing pin rearward into the cocked position using the cocking handle. Then, the user uses their thumb on the hand wearing the ring to depress the trigger and fire the revolver.

After discharging the revolver, the user manually rotates the cylinder to align another cartridge with the firing pin to be ready to fire again after cocking the firing pin. After five shots, the user removes the cylinder from the frame, empties the used cartridges from the passages, and reloads the passages with new cartridges. Once the cylinder is reattached to the frame, the revolver is ready for five more shots.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a revolver has been described in detail, it should be apparent that modifications and variations thereto are possible, all of which fall within the true spirit and scope of the invention. Although rifles have been disclosed, the revolver is also suitable for use with shotguns, light and medium machine guns, and other firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A revolver comprising:

a frame;

a cylinder rotatably mounted to the frame and defining a plurality of passages, defining a cylinder rotation axis, and having a cylinder periphery as a selected cylinder radius from the cylinder axis;

each passage having a chamber configured to receive a cartridge;

each passage defining a bore forward of the chamber and configured to closely receive a bullet and retain propellant pressure to expel the bullet;

each bore having a forward aperture;

wherein the frame includes a ring defining an aperture free of a trigger and configured to receive a first finger;

wherein the ring is aft of at least a portion of the cylinder and at least a portion of the ring is within the cylinder radius of the cylinder axis, such that at least a portion of the ring is directly behind the cylinder axis, including a frame plate between the cylinder and the frame wherein the frame defines a firing pin bore having a width, the frame plate defines a firing pin aperture having a width less than the firing pin bore width, and wherein the frame plate has a rear surface facing the frame, the rear surface defining a firing pin safety pocket away from the firing pin aperture, and configured to receive the firing pin.

2. The revolver of claim 1 including a firing facility connected to the frame rearward of the cylinder and registered with a selected one of the passages, the revolver being free of elements forward of the selected one of the passages.

3. The revolver of claim 1 including a finger rest outside of the ring and configured to engage a second finger.

4. The revolver of claim 3 wherein the finger rest is an elongated arcuate extension having a free end away from the frame.

5. The revolver of claim 1 including a firing pin received in the firing pin bore and having a firing pin protrusion configured to pass through the firing pin aperture to discharge a cartridge.

6. The revolver of claim 1 including a spring detent element on the frame facing the cylinder, and the cylinder defining a plurality of detent pockets, each associated with a passage.

7. A revolver comprising:

a frame;

a cylinder rotatably mounted to the frame and defining a plurality of passages, defining a cylinder rotation axis, and having a cylinder periphery as a selected cylinder radius from the cylinder axis;

each passage having a chamber configured to receive a cartridge;

each passage defining a bore forward of the chamber and configured to closely receive a bullet and retain propellant pressure to expel the bullet;

each bore having a forward aperture;

wherein the frame includes a ring defining an aperture free of a trigger and configured to receive a first finger;

wherein the ring is aft of at least a portion of the cylinder and at least a portion of the ring is within the cylinder radius of the cylinder axis, such that at least a portion of the ring is directly behind the cylinder axis, wherein the frame defines a firing pin bore receiving a firing pin configured to reciprocate between a rear cocked position and a forward discharge position and spring biased in a forward direction, the firing pin having a forward-facing shoulder, the frame defining a trigger passage transverse to the firing pin bore.

8. The revolver of claim 7 including a trigger element defining an aperture receiving the firing pin.

9. The revolver of claim 8 wherein the trigger element includes a sear surface operably engaging the forward-facing shoulder of the firing pin and configured to releasably engage the firing pin.

10. The revolver of claim 8 wherein the trigger element reciprocates with respect to the frame.

11. The revolver of claim 7 including a firing facility connected to the frame rearward of the cylinder and registered with a selected one of the passages, the revolver being free of elements forward of the selected one of the passages.

12. A revolver comprising:

a frame;

a cylinder rotatably mounted to the frame and defining a plurality of passages, and defining a cylinder rotation axis, and having a cylinder periphery as a selected cylinder radius from the cylinder axis;

each passage having a chamber configured to receive a cartridge;

each passage defining a bore forward of the chamber and configured to closely receive a bullet and retain propellant pressure to expel the bullet;

each bore having a forward aperture;

wherein the frame includes a ring defining an aperture free of a trigger and configured to receive a first finger;

wherein the ring is aft of at least a portion of the cylinder and at least a portion of the ring is within the cylinder radius of the cylinder axis, such that at least a portion of the ring is directly behind the cylinder axis, wherein the frame defines a firing pin bore having a forward aperture receiving a firing pin, the firing pin bore having a forward-facing stop surface, and the firing pin having an engagement surface configured to compress the firing pin spring between the engagement surface and the forward-facing stop surface and to limit rearward excursion of the firing pin.

13. The revolver of claim 12 wherein the firing pin is removable from the frame only in a forward direction.

14. The revolver of claim 13 including a frame plate forward of the firing pin and configured to prevent removal of the firing pin from the frame except upon removal of the frame plate.

15. The revolver of claim 12 including a firing facility connected to the frame rearward of the cylinder and registered with a selected one of the passages, the revolver being free of elements forward of the selected one of the passages.

16. A revolver comprising:

a frame;

a cylinder rotatably mounted to the frame and defining a plurality of passages, defining a cylinder rotation axis, and having a cylinder periphery as a selected cylinder radius from the cylinder axis;

each passage having a chamber configured to receive a cartridge;

each passage defining a bore forward of the chamber and configured to closely receive a bullet and retain propellant pressure to expel the bullet;

each bore having a forward aperture;

wherein the frame includes a ring defining an aperture free of a trigger and configured to receive a first finger;

wherein the ring is aft of at least a portion of the cylinder and at least a portion of the ring is within the cylinder radius of the cylinder axis, such that at least a portion of the ring is directly behind the cylinder axis;

wherein the frame defines a firing pin bore, a firing pin received in the firing pin bore, the firing pin having a rear end including a cocking handle configured to withdraw the firing pin in a rearward direction to cock the revolver.

17. The revolver of claim 16 including a firing facility connected to the frame rearward of the cylinder and registered with a selected one of the passages, the revolver being free of elements forward of the selected one of the passages.

* * * * *